US008370962B2

(12) United States Patent
McBride et al.

(10) Patent No.: US 8,370,962 B2
(45) Date of Patent: Feb. 12, 2013

(54) RAPID DOFFING VEST

(76) Inventors: William B. McBride, Tallahassee, FL (US); John Rogers, Atlanta, GA (US)

( * ) Notice: Subject to any disclaimer, the term of this patent is extended or adjusted under 35 U.S.C. 154(b) by 1631 days.

(21) Appl. No.: 11/823,190

(22) Filed: Jun. 26, 2007

(65) Prior Publication Data

US 2012/0174286 A1 Jul. 12, 2012

(51) Int. Cl.
*F41H 1/02* (2006.01)

(52) U.S. Cl. ..... 2/2.5; 2/102

(58) Field of Classification Search ..... 2/102, 460, 2/461, 462, 463, 467, 456, 464, 465, 44, 2/108, 94, 2.592, 96, 2.5, 92; 89/36.05, 36.01, 89/36.04; 24/458, 573.09, 578.1, 578.13
See application file for complete search history.

(56) References Cited

U.S. PATENT DOCUMENTS

| | | | | | |
|---|---|---|---|---|---|
| 2,522,790 | A | | 9/1950 | Johnston | |
| 3,125,865 | A | * | 3/1964 | Bemelman | 62/259.3 |
| 3,452,362 | A | * | 7/1969 | Korolick et al. | 2/2.5 |
| 3,452,554 | A | * | 7/1969 | Smith | 62/259.3 |
| 3,557,384 | A | * | 1/1971 | Barron et al. | 2/2.5 |
| 3,777,309 | A | * | 12/1973 | Yeager | 2/2.5 |
| 4,106,121 | A | | 8/1978 | Johnston | |
| 4,601,067 | A | * | 7/1986 | Buonassissi | 2/102 |
| 4,694,505 | A | * | 9/1987 | Flosi et al. | 2/462 |
| 4,738,119 | A | * | 4/1988 | Zafred | 607/104 |
| 4,964,282 | A | * | 10/1990 | Wagner | 62/259.3 |
| 5,060,314 | A | | 10/1991 | Lewis | |
| 5,415,222 | A | * | 5/1995 | Colvin et al. | 165/46 |
| 5,512,348 | A | | 4/1996 | Mazelsky | |
| 5,832,573 | A | | 11/1998 | Howell | |
| 5,978,961 | A | | 11/1999 | Barker | |
| 5,991,925 | A | | 11/1999 | Wu | |
| 6,189,149 | B1 | * | 2/2001 | Allen | 2/102 |
| 6,769,137 | B2 | | 8/2004 | D'Annunzio | |
| 6,948,188 | B2 | | 9/2005 | D'Annunzio | |
| 6,961,957 | B2 | | 11/2005 | Carlson | |
| 7,001,417 | B2 | * | 2/2006 | Elkins | 607/104 |
| 7,047,570 | B2 | | 5/2006 | Johnson | |
| 7,073,234 | B2 | | 7/2006 | Turpin | |
| 7,424,748 | B1 | * | 9/2008 | McDunn et al. | 2/2.5 |
| 7,814,567 | B2 | * | 10/2010 | Dovner et al. | 2/2.5 |
| 7,979,917 | B2 | * | 7/2011 | Osborne | 2/2.5 |
| 7,987,523 | B2 | * | 8/2011 | Cole et al. | 2/102 |
| 8,015,618 | B2 | * | 9/2011 | Paull | 2/69 |
| 2002/0016984 | A1 | * | 2/2002 | Poholski | 2/94 |
| 2005/0005343 | A1 | * | 1/2005 | Johnson | 2/102 |
| 2007/0083975 | A1 | * | 4/2007 | Senegal | 2/102 |
| 2007/0107109 | A1 | | 5/2007 | Johnson | |

* cited by examiner

*Primary Examiner* — Khoa Huynh
*Assistant Examiner* — Brieanna Fuller
(74) *Attorney, Agent, or Firm* — Peter Loffler

(57) ABSTRACT

A rapid doffing and donning vest uses a clam shell design wherein the ends of the cummerbund are removably attachable to the rear panel. A blade on the cummerbund mates with a receiver on the rear panel and has a plunger hold the two together. The plunger is attached to a pull strap located on the front panel's shoulder strap via a cord. As the pull strap is pulled outwardly, the cord pulls the plunger away from the mated blade and receiver and allows the two to decouple detaching the cummerbund from the rear panel. Outward pulling on the pull strap also facilitates decoupling of the shoulder strap from the rear panel. When the vest is doffed, the front panel and cummerbund remain attached to each other and detached from the rear panel.

10 Claims, 7 Drawing Sheets

RAPID DOFFING VEST

BACKGROUND OF THE INVENTION

1. Field of the Invention

The present invention relates to a vest, such as a bullet and shrapnel resistant vest worn by military personnel, which vest can be rapidly doffed by the wearer. The vest can be quickly donned.

2. Background of the Prior Art

Military and paramilitary body armor has developed primarily through numerous wars and has included such innovations and stages as chain mail and full metal armor for knights. More recent versions began with the "flack jackets" worn by World War II bomber crews. Besides those in the air, United States troops on the ground began wearing armor in the latter stages of the Viet Nam War. This body armor had numerous disadvantages including the armor's weight, its restriction of movement, its discomfort from heat and its lack of providing protection for portions of the trunk of the body. Recent years have seen tremendous improvements in materials and design that have resulted in several improvements in the body armor, especially in the amount of protection provided and the relative comfort increase for those wearing such armor. The improvements herein continue in this direction.

A body armor vest in wide use is the clam shell vest with cummerbund. This design uses a rear plate that covers the back with the opposing ends of a cummerbund attached to respective opposing sides of the rear plate, the medial section of the cummerbund being removably attachable to itself to effect sizing about the torso of the wearer. A front plate is attached to the rear plate by having shoulder straps on the front plate removably attach to the rear plate via the use of cooperating hook and loop material (including the newer dart and hook) and side panels of the front plate removably attached to the cummerbund, again with cooperating hook and loop material.

Although a marked improvement over to previous generations of body armor, the basic clam shell design still has certain limitations for which further improvements continue to be needed. Oftentimes, the body armor needs to be shed quickly by the wearer. For example, when an explosion occurs near a vehicle, an occupant may have need to quickly exit the vehicle, especially if the vehicle is on fire. If any part of the vest is not capable of extraction from the vehicle or parts thereof, the wearer must shed the vest to escape injury from secondary sources as well as to get into the fight if necessary. If the wearer cannot escape the vehicle in a timely manner due to the vest being caught, such a person can be injured or killed or may not be able to help support his or her fellow soldiers in the fight against the enemy. When a wearer of a vest is wounded, medics generally need to remove the vest to effect treatment. Sooner removal is invariably better than later. Delays in vest removal oftentimes result in higher casualties among the (already) wounded as well as the medics.

As many body armor suits are made from an incredibly strong material, simply cutting the vest off of a wounded soldier is not practical, the armor must have a secondary ability for quick removal. Ideally, the vest should be able to be quickly and easily reassembled in order to be donned by the wearer for continued protection.

Many battlefields are found in warm and hot climates or in cold climates. Wearing of vests in warm and hot climates, while offering protection from projectiles, can result in early exhaustion, heat prostration, and dehydration for the wearer. Cold climates also cause problems for the soldier. These conditions reduce effectiveness of the wearer and sometimes result in a soldier needing medical attention or even in the death of the soldier.

Present vests offer numerous "tie-down" points for carrying and retaining supplies such as fighting load components, including ammunition pouches, grenade pouches, hydration systems, etc., or medical supplies, communication supplies, etc. However, the time required to utilize these tie-down points reduces the wearer's effectiveness. A system is needed whereby the wearer can quickly replace equipment and supplies while having them readily available when needed.

A body armor vest is needed that addresses the above-mentioned shortcomings found in the art. Specifically, such a body armor vest must be quickly and easily doffed by the wearer so that if a wearer needs to extricate himself or herself from a situation wherein the vest inhibits such extrication, the vest is shed, allowing the fighter to escape, or in the case of a wounded soldier, the body armor can be quickly removed in order to allow medical personal to administer treatment as soon as possible. Additionally, such a vest should provide for keeping a wearer relatively cool in warm climate conditions and warm in cold climates. Furthermore, such a vest should provide tie-down points on the vest which points can carry and retain needed equipment and supplies which retention system allows for quick removal from and reattachment to the vest of the needed equipment and supplies.

Such a vest must be utilizable with various body armor configurations including the basic body armor outer tactical vest, with or without yoke and collar, as well as other body protectors including throat protectors, groin protectors, etc. The vest should have the ability to carry enhanced small arms protective inserts and enhanced ballistic inserts and carriers. The vest must not impede soldier tasks including the operation of individual weapons such as a rifle, grenade launcher, and pistol, must not impede the operation of crew served weapons, nor impede the ability to throw fragmentation and smoke grenades. Such a vest must allow for safe operation, ingress, and emergency egress of combat vehicles including the M1A1 Abrams Tank, the Bradley Fighting Vehicle, and an Armored Security Vehicle as well as tactical vehicles such as the Up Armored HMMWV. Such a vest should be able to provide for a tailored capability to incorporate modular extremity protection system components for the shoulder such as the Deltoid Auxiliary Protection System as well as arm and leg protection.

SUMMARY OF THE INVENTION

The rapid doffing vest of the present invention addresses the aforementioned needs by providing a body armor vest that can be quickly and easily doffed by the wearer so that if a wearer needs to extricate himself or herself from a situation, wherein the vest inhibits such extrication, the vest can be quickly and easily shed, allowing the wearer to escape, or in the case of a wounded soldier, the body armor can be quickly removed by medical or other personnel in order to allow the medical personal to administer treatment as soon as possible and possibly reassemble the vest on the patient after treatment. The rapid doffing vest makes provisions for keeping a wearer relatively cool in warm climate conditions and warm in cold climates. The rapid doffing vest provides tie-down points on the vest which tie-down points can carry and retain needed equipment and supplies which retention system allows for quick removal from and reattachment to the vest of the needed equipment and supplies with the flexibility to arrange the load without restricting the ability to don and doff the vest.

The rapid doffing vest of the present invention is very flexible in that it can be configured as needed for the battlefield so that the rapid doffing and the rapid donning functions do not interfere with such configurations and allow the overall body armor system to be utilizable with various configurations including the basic body armor outer tactical vest, with or without yoke and collar, as well as other body protectors including throat protectors, groin protectors, etc. The rapid doffing vest is configurable to have the ability to carry enhanced small arms protective inserts and enhanced ballistic inserts and carriers including the ability to adjust the plates up and down within their pockets. The rapid doffing vest does not impede soldier tasks including the operation of individual weapons such as a rifle, grenade launcher, and pistol, does not impede the operation of crew served weapons, nor does the rapid doffing vest impede the ability to throw fragmentation and smoke grenades. The rapid doffing vest allows for safe operation, ingress, and emergency egress of combat vehicles including the M1A1 Abrams Tank, the Bradley Fighting Vehicle, and an Armored Security Vehicle as well as tactical vehicles such as the Up Armored HMMWV. The rapid doffing vest may provide for a tailored capability to incorporate modular extremity protection system components for the shoulder such as the Deltoid Auxiliary Protection System as well as arm and leg protection.

The rapid doffing vest of the present invention is comprised of a rear panel that has a first outer surface, a first inner surface, a top, a bottom, and a pair of opposing sides. A front panel has a second outer surface, a second inner surface, and a pair of spaced apart shoulder straps that are each removably attachable to the first outer surface of the rear panel. A size-adjustable cummerbund has a pair of ends such that each end is attached to a respective one of the sides of the rear panel and at least one of the ends is removably attachable to its respective side via an attachment system. The attachment system comprises a blade that is attached to the end of the cummerbund, a blade receiver that is attached to the side of the rear panel such that the blade is laterally received within the blade receiver, and a plunger that has an upper surface and a lower surface, such that the plunger is removably attached to the blade receiver in order to prevent lateral movement of the blade with respect to the blade receiver whenever the blade is received within the blade receiver. At least one stop is located on the blade receiver in order to prevent longitudinal movement of the blade with respect to the blade receiver whenever the blade is received within the blade receiver, the stop may be located at the top of the blade receiver, at the bottom thereof, or at both locations. A cord is attached to the upper surface of the plunger. The cord is removably attached to a respective one of the shoulder straps of the front panel via a pull strap. A keeper is located on the shoulder strap while is stop located on the cord between the keeper and the plunger such that when the stop encounters the keeper, further cord travel through the keeper is prevented. A guide is attached to the outer surface of the rear panel above the receiver such that the cord passes through the guide. The upper surface of the plunger is rounded and tapered in order to prevent snagging of the plunger on the guide as the plunger rapidly passes through the guide. The plunger is received within a plunger receiver that is located on the blade receiver such that a notch on the blade aligns with the plunger receiver whenever the blade is received within the blade receiver and such that the plunger prevents lateral notch travel in order to prevent the lateral movement of the blade. A reservoir is located on the second inner surface of the front panel. At least one capillary tube extends downwardly from the reservoir and has at least one opening located thereon. A load receiver is located on the second outer surface of the front panel to which a load carrier is removably attachable. A pocket is located on the first inner surface of the rear panel such that a thermal pack is removably receivable within the pocket, the thermal pack may, but need not necessarily be eutectic salt based.

BRIEF DESCRIPTION OF THE DRAWINGS

Similar reference numerals refer to similar parts throughout the several views of the drawings.

DESCRIPTION OF THE PREFERRED EMBODIMENT

Figure 1:
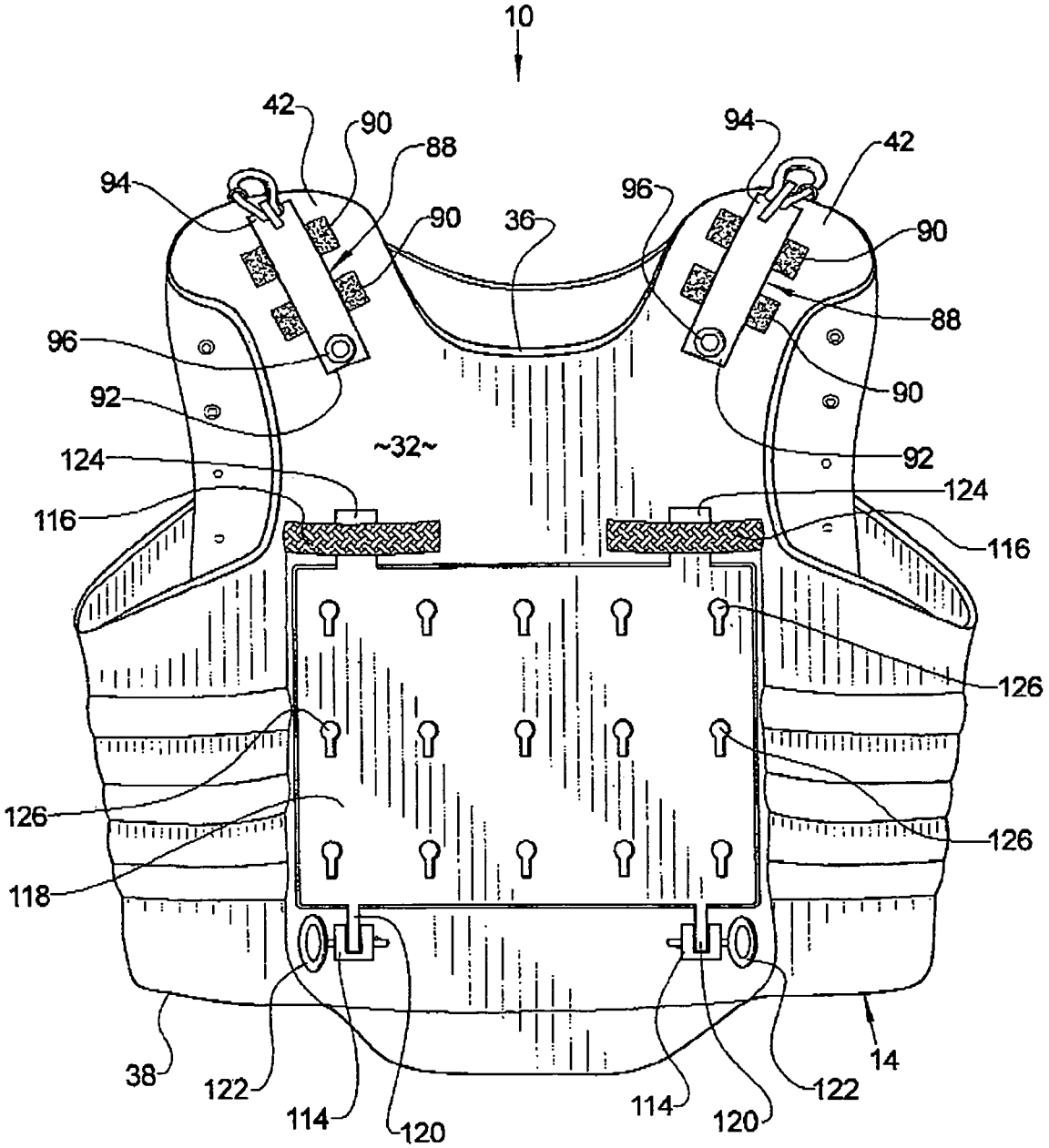
FIG. 1 is a perspective view of the front of the rapid doffing vest of the present invention illustrating the load receiver.
Figure 2:
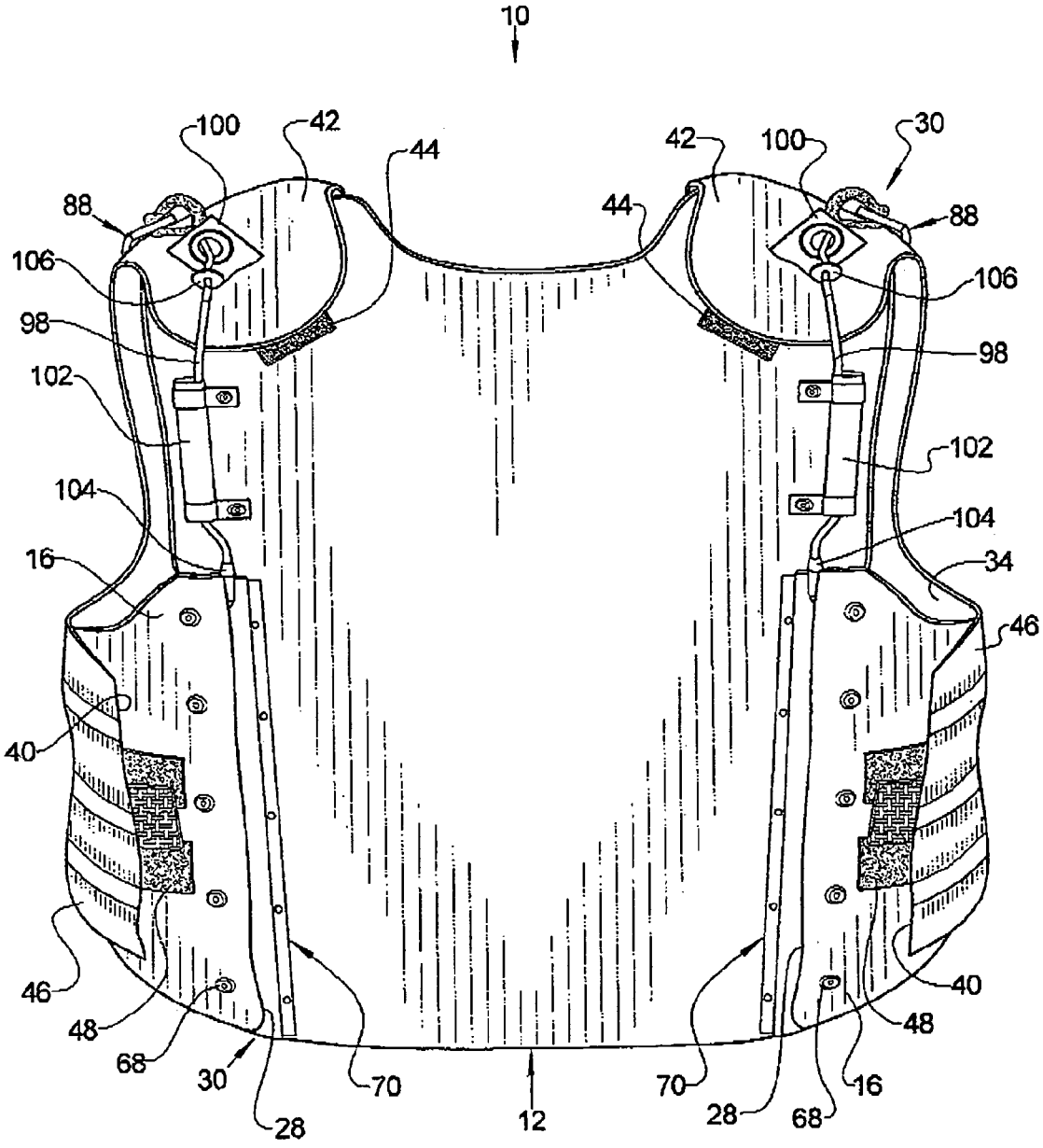
FIG. 2 is perspective view of the rear of the rapid doffing vest.
Figure 3:
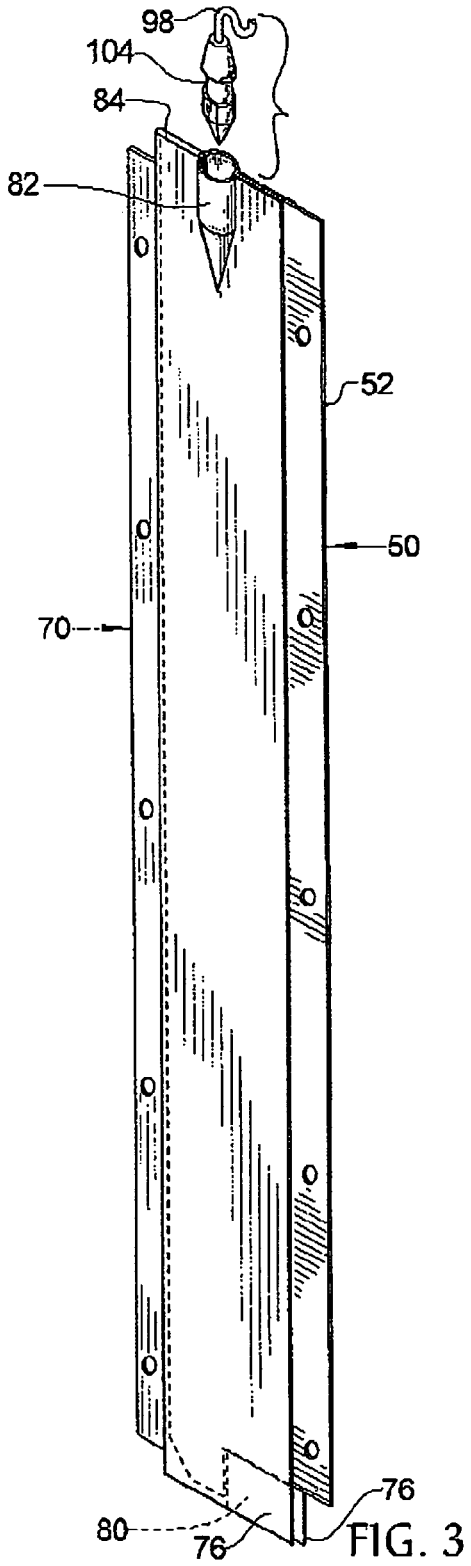
FIG. 3 is a perspective view of the female blade receiver mated with the male blade of the quick-release hinge of the rapid doffing vest.
Figure 4:
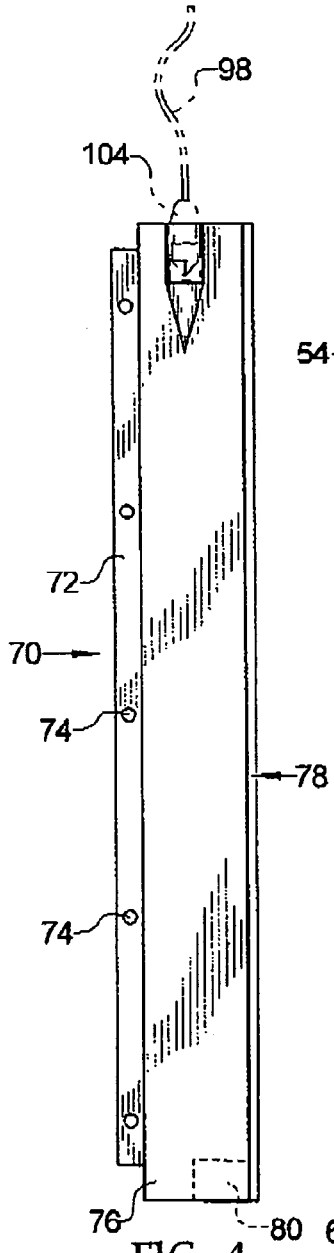
FIG. 4 is an elevation view of the female blade receiver.
Figure 5:
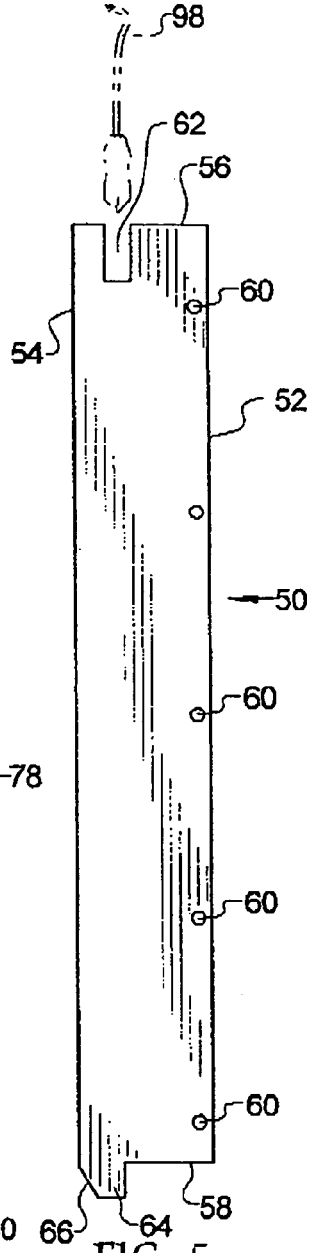
FIG. 5 is an elevation view of the male blade.
Figure 6:
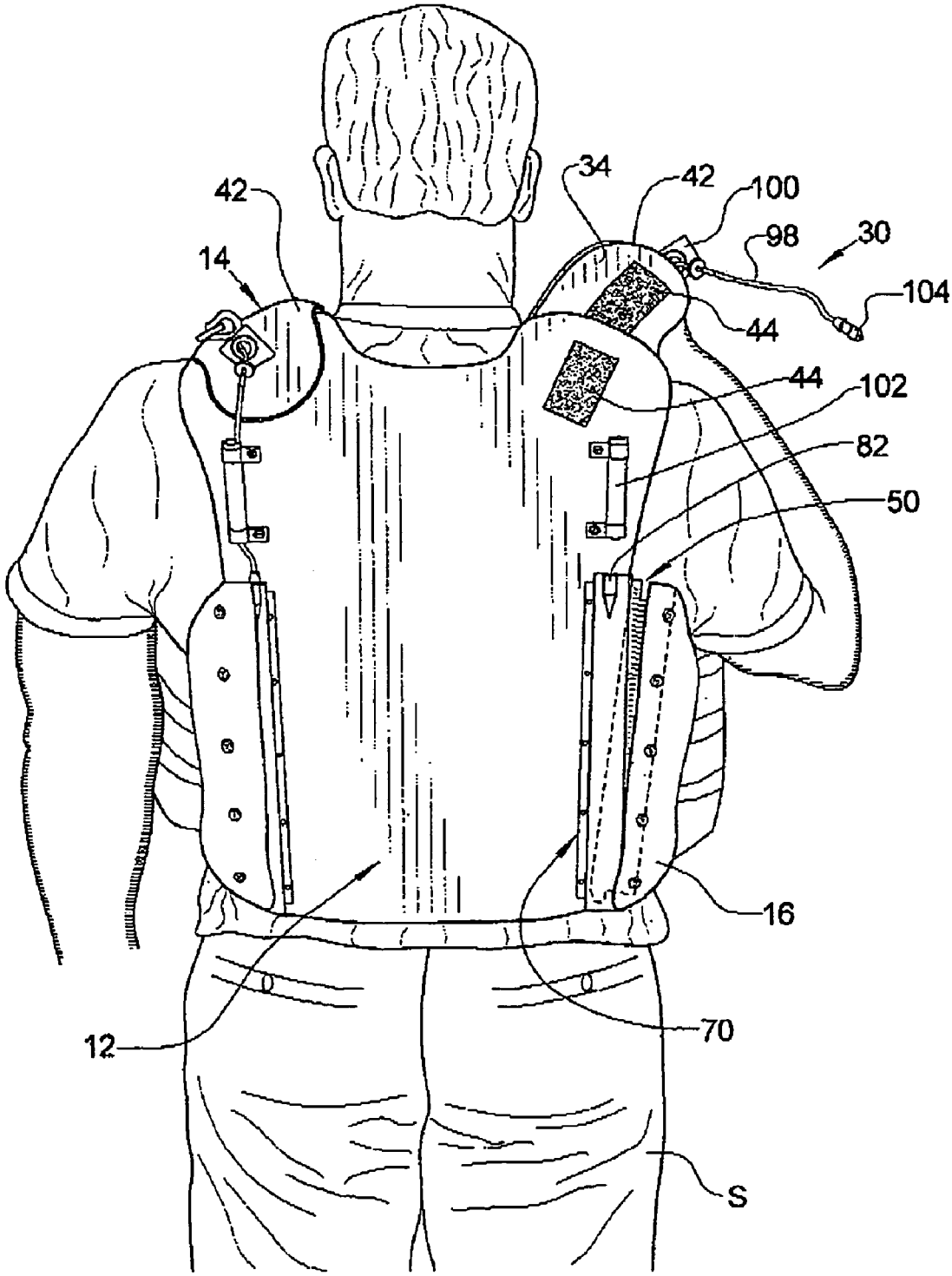
FIG. 6 is an elevation view of the rapid doffing vest donned by a wearer wherein the release mechanism is partially opened on one side.
Figure 7:
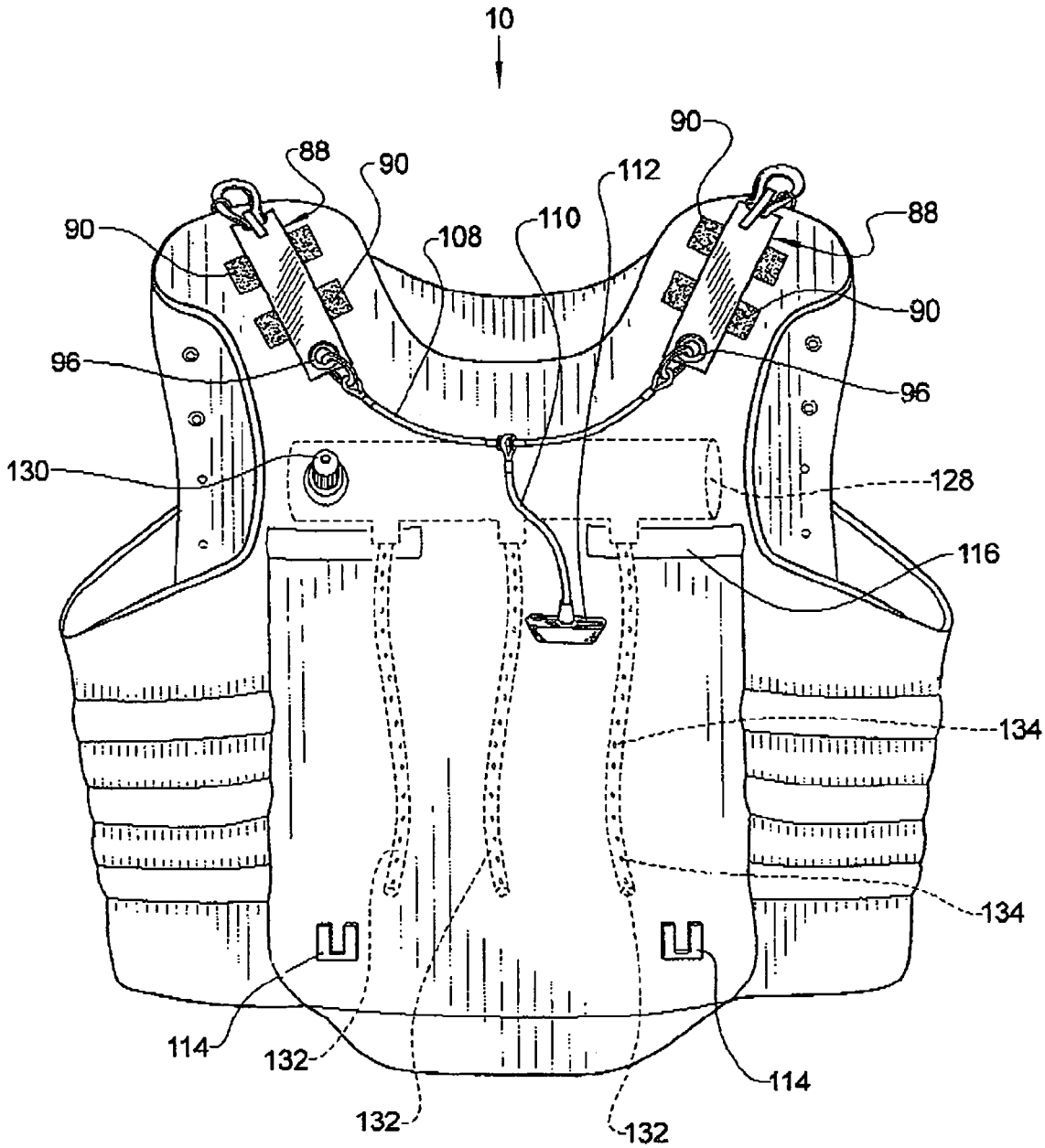
FIG. 7 is a perspective view of the front of the rapid doffing vest illustrating the water cooling reservoir and drip manifold.
Figure 8:
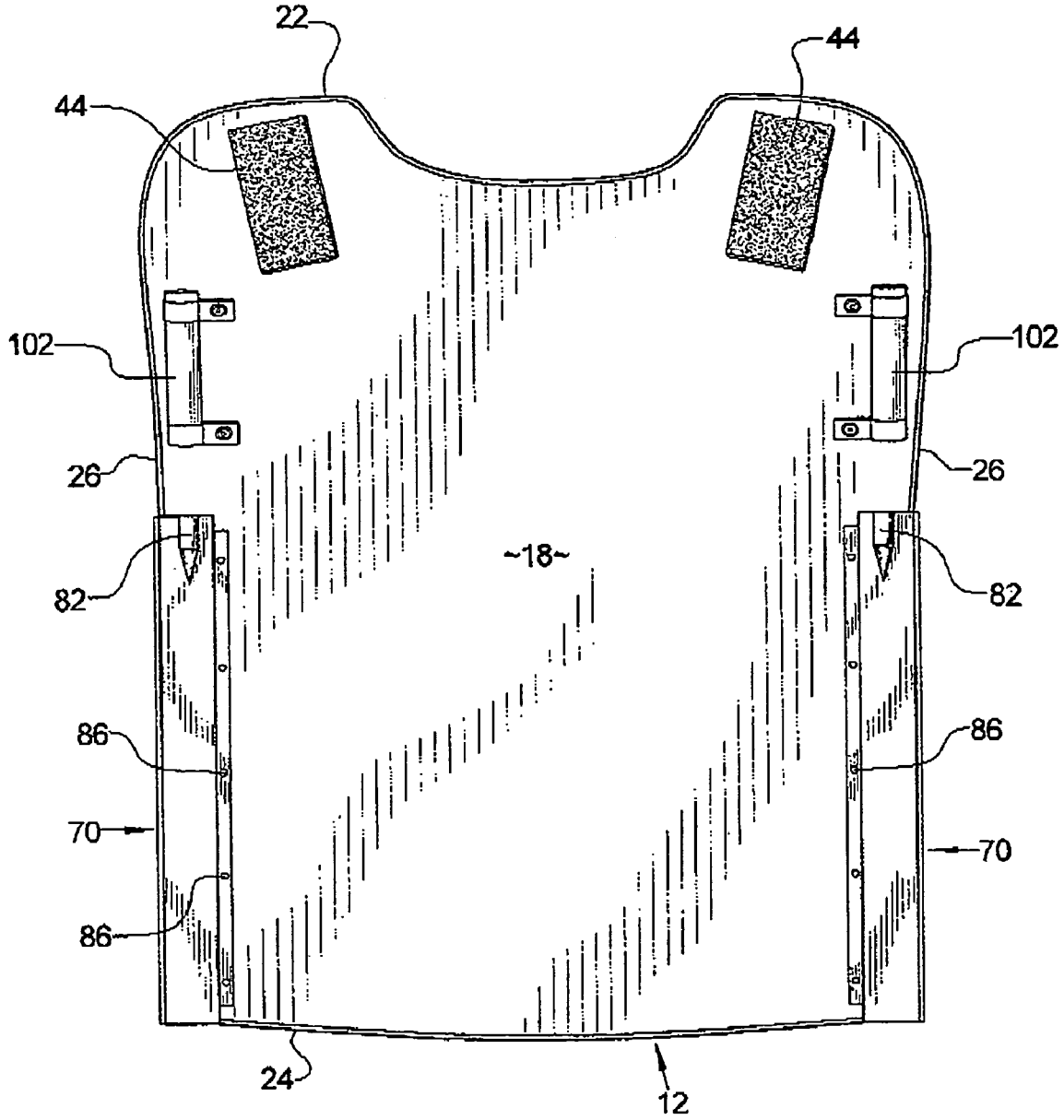
FIG. 8 is an elevation view of the outer surface of the rear panel.

Referring now to the drawings, it is seen that the rapid doffing vest of the present invention, generally denoted by reference numeral 10, improves on the typical clam shell design and is comprised of a rear panel 12, a front panel 14 that is removably attached to the rear panel 12, and a cummerbund 16 that is also removably attachable to the rear panel 12. As seen, the rear panel 12 has an outer surface 18 and an inner surface 20, the inner surface 20 being positioned so as to face the back of the wearer S when the vest 10 is worn. The rear panel 12 also has a top 22, a bottom 24, a pair of sides 26. One or advantageously each end 28 of the cummerbund 16 is removably attachable to its respective side 26 of the rear panel 12 via an attachment system 30 as will be more fully discussed infra. The medial section of the cummerbund 16 attaches to itself in the usual way (attachment not illustrated) in order to provide sizing of the rear panel 12 about the torso of the wearer S. The front panel 14 also has an outer surface 32 and an inner surface 34, which faces the torso of the wearer S when the vest 10 is worn, and has a top 36, a bottom 38, and a pair of sides 40. A pair of shoulder straps 42 extends from the top 36 of the rear panel 12 proximate each side 40 and each shoulder strap 42 is removably attachable to the outer surface 18 of the rear panel 12 by the use of cooperating hook and loop material 44 (through the specification, hook and loop material includes and encompasses dart and loop and other similar materials) positioned on the inner surface 34 of the shoulder straps 42 of the front panel 14 and correspondingly on the outer surface 18 of the rear panel 12 proximate the rear panel's top 22. The side panels 46 of the front panel 14 removably attach to the cummerbunds 16 in the usual way by providing hook and loop material 48 on the inner surface 34 of the side panels 46 of the front panel 14 and correspondingly on the cummerbund 16 proximate each end 28 thereof.

The attachment system 30 comprises a male blade 50 that is a generally flat plate member made from a hard material such as a stiff plastic or metal and has a first side edge 52, an opposing second side edge 54, a top edge 56, and a bottom edge 58. As seen, a series of openings 60 are located along the first side edge 52. A generally rectangular notch 62 is located on the top edge 56 while an extension 64 extends downwardly from the bottom edge 58 at the second side edge 54, the extension 64 having a diagonal cut 66. Each male blade 50 is attached to a respective end 28 of the cummerbund 16 (or just one male blade 50 is attached to one of the ends 28 of the cummerbund 16) by using appropriate fasteners 68 such as rivets, etc., and passing such fasteners 68 through respective openings 60 on the male blade 50 and corresponding openings (not illustrated) on the cummerbund 16.

A corresponding female blade receiver 70 has a rib 72 on one side, the rib 72 having a series of openings 74 extending along the length thereof. Extending from the rib 72, is a pair of parallel blade panels 76 that are spaced apart from each other to form a channel 78 therebetween. A rest 80 is located at the bottom of the channel 78, while a plunger receiver 82 is formed at the top of the pair of blade panels 76, the plunger receiver 82 being generally cylindrical in shape and may have a conical distal end for manufacturing expediency. The tops of the blade panels 76 between the rib 72 and the plunger receiver 82 are joined together in order to form a closed section 84 of the channel 78 at that point. Each female blade receiver 70, which is also made from an appropriate hard material such as metal, plastic, etc., is attached to its respective side 26 of outer surface 18 of the rear panel 12 by also using an appropriate fastener 86 such as rivets and passing such fasteners 86 through respective openings 74 on the female blade receiver 70 and corresponding openings (not illustrated) on the rear panel 12.

A pull strap 88 is removably attachable to the outer surface 18 of the shoulder strap 42 of the front panel 14 by the use of cooperating hook and loop material sections 90 on the pull strap 88 and correspondingly on the shoulder strap 42. The pull strap 88 has a lower end 92 and an upper end 94, the lower end 92 of the pull strap 88 having a grommet 96 thereat. A pull cord 98 is attached to the upper end 94 of the pull strap 88 in appropriate fashion. The pull cord 98 passes through a keeper 100 attached to shoulder strap 42 above the pull strap 88 and through a guide 102 attached to the outer surface 18 of the rear panel 12, the guide 102 located between the female blade receiver 70 and the section of hook and loop material 44 on the outer surface 18 of the rear panel 12 that mates with the corresponding hook and loop material 44 on the shoulder strap 42. The guide 102, which is a hollow tubular member, has its longitudinal axis generally aligned with plunger receiver 82. A plunger 104 is located on the distal end of the pull cord 98 while a stop 106 is located medially along the pull cord 98 proximate the keeper 100, the stop 106 located between the keeper 100 and the plunger 104, the stop 106 preventing further advancement of the pull cord 98 through the keeper 100. If desired, a connecter cord 108 connects the two grommets 96 on the respective pull straps 88 and may further have a tether 110 extending medially from the connecter cord 108, the tether 110 having a pull handle 112 on a distal end thereof.

In order to attach each end 28 of the cummerbund 16 to its respective side 26 of the rear panel 12, the male blade 50 is received within a respective one of the female blade receivers 70 by passing the second side edge 54 of the male blade 50 into the channel 78 of the female blade receiver 70 until the second side edge 54 reaches the back end of the channel 78. The extension 64 of the male blade 50 passes over the step 80 and thereafter seats within the cavity formed between the rest 80 and the back end of the channel 78, the cut 66 in the extension 64 the male blade 50 be angularly inserted into the female blade receiver 70. Once the male blade 50 is fully received within the female blade receiver 70 and the two are parallel with one another, the notch 62 is within the plunger receiver 82. At this point, the plunger 104 is inserted into the plunger receiver 82 wherein the plunger 104 is frictionally held. The male blade 50 is locked to the female blade receiver 70 as the plunger 104, by being inserted into the plunger receiver 82 that is aligned with the notch 62 of the male blade 50, prevents the top 56 of the male blade 50 from being retracted laterally out of the female blade receiver 70 while the step 80 within the female blade receiver 70 acts as a stop and prevents the extension 64 of the male blade 50 from being laterally retracted from the female blade receiver 70 and also prevents the male blade 50 from sliding longitudinally downwardly within the channel 78. The closed section 84 of the channel 78 acts as another stop and prevents the male blade 50 from sliding longitudinally upwardly within the channel 78. Each side of the vest 10 is similarly attached.

The vest 10 is donned by attaching the cummerbund 16 to the rear panel 12 as described and sizing the rear panel 12 about the wearer via the cummerbund 16. Thereafter, the front panel 14 is attached by attaching the shoulder straps 42 to the rear panel and attaching the side panels 46 to the cummerbund 16, the front panel 14 being in proximity to the wearer S during rear panel 12 donning due to the fact that the pull cord 98 upon which the plunger 104 is attached, is attached to the front panel 14.

In order to doff the vest 10, then the pull strap 88 is grasped and pulled outwardly, either via each pull strap 88 being pulled directly or via the pair of pull straps 88 being pulled via the connector strap 108 and/or the tether 110 including pull handle 112. The outward pulling on the pull strap 88 causes the shoulder strap 42 to decouple from the rear panel 12 and also causes an upward pull on the pull cord 98 in order to extract the plunger 104 from the plunger receiver 82 as well as through the pull cord guide 102, the upper surface of the plunger 104 being rounded and tapered in order to help prevent the plunger 104 from getting caught on the pull cord guide 102, the stop 106 preventing further advancement of the pull cord 98 once the pull cord 98 has traveled a sufficient amount. Once the plunger 104 is so extracted, the top 56 of the male blade 50 falls outwardly out of the female blade receiver 70 due to gravity (or force of the wearer S or other personnel). If the wearer S is upright, gravity will cause the male blade 50 to pivot within the female blade receiver 70 about the extension 64, the cut 66 allowing such pivotal action, the male blade 50 eventually coming free of the female blade receiver 70. If the wearer S is not gravitationally positioned for this to occur, then the wearer S or other personal can effect such pivoting and lateral extraction. Each side of cummerbund 16 to rear panel 12 attachment is so effected, and once each side is so detached, the front panel 14 is detached from the rear panel 12 and the vest 10 is clear of the torso from the wearer S with the cummerbund 16 remaining attached to the front panel 14.

During normal wearing of the vest 10, the pull cord guide 102 helps prevent the pull cord 98 from being caught on something or otherwise being bunched and also helps to laterally deflect any undesired pull on the pull cord 98 should the pull cord 98 be caught on something, thereby helping minimize unwanted removal of the plunger 104 from the plunger receiver 82. Additionally, as the stop 106 is a short distance from the keeper 100, the keeper 100 by catching the stop 106 after only a short distance of travel by the pull cord 98 also helps minimize unwanted removal of the plunger 104 from the plunger receiver 82.

The rapid doffing vest 10 may have additional features.

As seen, a pair of receivers 114 is located on the outer surface 32 of the front panel 14 proximate the front panel's lower edge 38, the receivers 114 being in spaced apart fashion to each other, while a pair of retainer straps 116 is located on the outer surface 32 of the front panel 14, one retainer strap 116 generally above each receiver 114. The ends of each retainer strap 116 are attached to the front panel 14, fixedly or otherwise, while the medial portion remains detached (or just removably attached). A load carrier 118 has a pair of lower leg 120 such that each lower leg 120 is received with a respective one of the receivers 114. A key 122 passes through corresponding openings (neither illustrated) on the receiver 114 and its respective lower leg 120. The load carrier 118 also has a pair of upper legs 124, such that each upper leg 124 is received between the ends of one of the respective retainer straps 116. As seen, the load carrier 118 has a series of keyhole openings 126 thereon, which openings 126 removably receive an appropriate load or supply thereat. Of course, the load carrier 118 may utilize different attachment methods for attaching loads to the load carrier 118.

A flexible fluid reservoir 128 may be located on the inner surface 34 of the front panel 14 (or within any protective material cover) and has a fill plug 130. One or more capillary tubes 132 depend downwardly from the reservoir 128, each tube 132 having a series of small openings 134.

Figure 9:
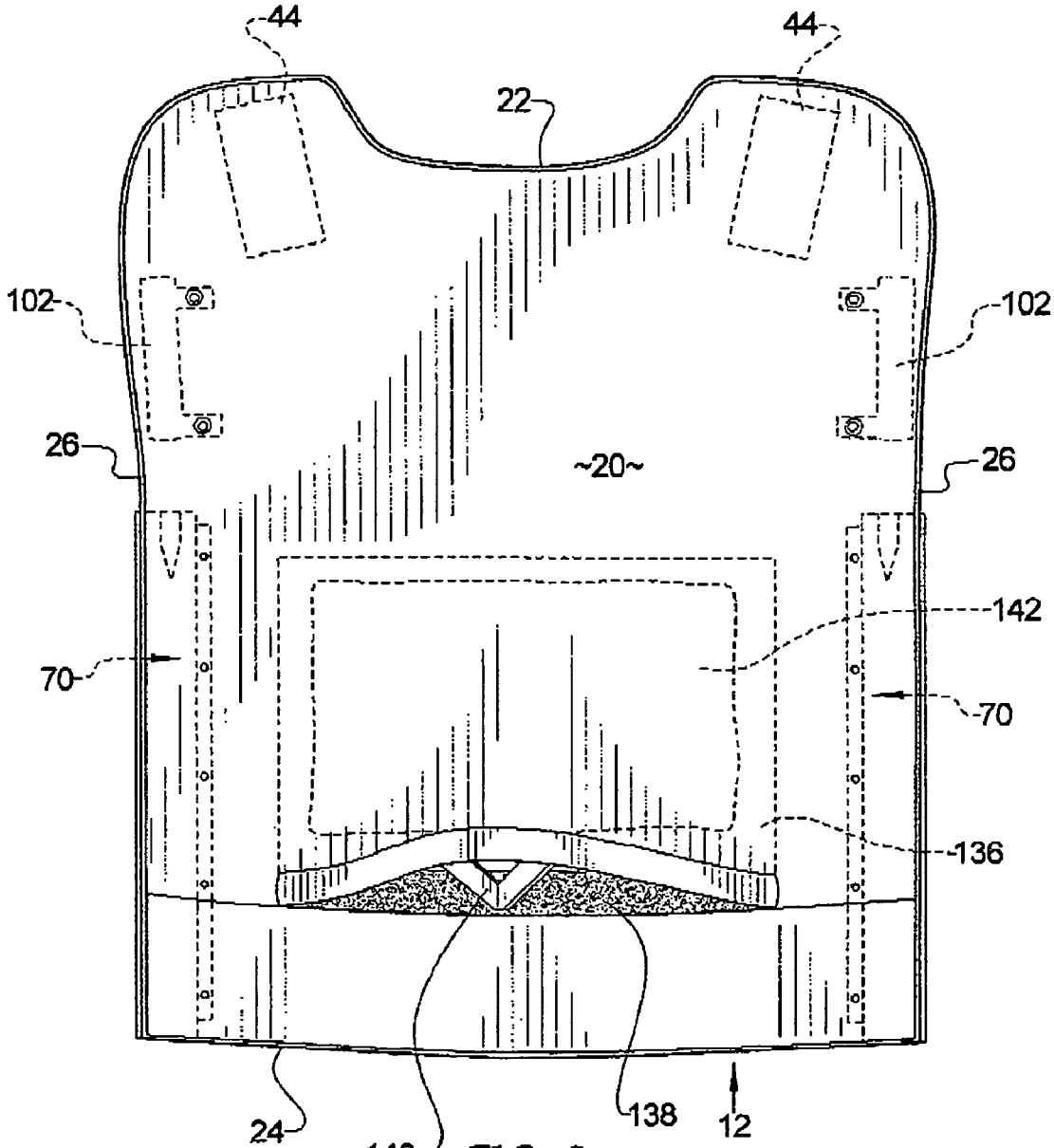
FIG. 9 is an elevation view of the inner surface of the rear panel illustrating the cooling pouch and pack provision.

As best seen in FIG. 9, a pouch 136 is located on the inner surface 20 of the rear panel 12 which pouch 136 has an appropriate hook and loop fastener 138 with pull handle 140. The pouch 136 is designed to removably hold a thermal pack 142, which may be filled with a eutectic salt.

Prior to donning the vest, and if so equipped, an appropriate pack or packs 142 may be placed into the pouch 136 so that such packs 130 provide cooling (or heating) for the wearer S especially around the kidney region.

If so equipped, the reservoir 128 may be filled with water via the fill plug 130 in order to allow the water to slowly drip onto the front torso of the wearer S via the capillaries 132 in order to provide evaporative cooling to the wearer.

If so equipped, a load carrier 118 may be attached to the front panel 14 and any desired loads or supplies loaded thereonto.

As noted previously, the vest 10 is designed to accommodate varying armor designs as required by the wearer or the entity so ordering the vests 10. The rapid doffing vest 10 of the present invention is concerned with rapid doffing and rapid donning of the vest 10, as well as cooling or warming and load carrying, irrespective of the specific armor architecture.

While the invention has been particularly shown and described with reference to an embodiment thereof, it will be appreciated by those skilled in the art that various changes in form and detail may be made without departing from the spirit and scope of the invention.

We claim:

1. A clam shell vest for wearing about the torso of a person, the vest comprising:

a rear panel having a first outer surface, a first inner surface, a top, a bottom, and a pair of opposing sides;

a front panel having a second outer surface, a second-inner surface, and a pair of spaced apart shoulder straps each shoulder strap removably attachable to the first outer surface of the rear panel;

a cummerbund having a pair of ends, each end attached to a respective one of the opposing sides of the rear panel and at least one of the ends of the cummerbund being removably attachable to its said respective one of the opposing sides of the rear panel via an attachment system;

the attachment system comprising:

a blade attached to said at least one end of the cummerbund;

a blade receiver attached to said respective one of the opposing sides of the rear panel such that the blade is laterally received within the blade receiver;

a plunger having an upper surface and a lower surface, the plunger removably attached to the blade receiver in order to prevent lateral movement of the blade with respect to the blade receiver whenever the blade is received within the blade receiver;

a cord attached to the upper surface of the plunger wherein the cord is attached to a respective one of the shoulder straps of the front panel;

a keeper located on said respective one of the shoulder straps; and a stop located on the cord between the keeper and the plunger such that when the stop encounters the keeper further cord travel through the keeper is prevented.

2. The vest as in claim 1 further comprising at least one stop located on the blade receiver in order to prevent longitudinal movement of the blade with respect to the blade receiver whenever the blade is received within the blade receiver.

3. The vest as in claim 1 wherein the cord is removably attached to said respective one of the shoulder straps of the front panel.

4. The vest as in claim 1 wherein the cord is removably attached to said respective one of the shoulder straps via a pull strap, said pull strap removably attachable to said respective one of the shoulder straps.

5. The vest as in claim 1 further comprising a guide attached to the first outer surface of the rear panel above the blade receiver such that the cord passes through the guide.

6. The vest as in claim 1 wherein the upper surface of the plunger is rounded and tapered.

7. The vest as in claim 1 wherein the plunger is received within a plunger receiver located on the blade receiver such that a notch on the blade aligns with the plunger receiver whenever the blade is received within the blade receiver and such that the plunger prevents lateral notch travel in order to prevent the lateral movement of the blade.

8. The vest as in claim 1 further comprising:

a reservoir located on the second inner surface of the front panel;

at least one capillary tube extending downwardly from the reservoir; and at least one opening located on the capillary tube.

9. The vest as in claim 1 further comprising:

a load receiver located on the second outer surface of the front panel; and a load carrier removably attachable to the load receiver.

10. The vest as in claim 1 further comprising:

a pocket located on the first inner surface of the rear panel; and a thermal pack removably receivable within the pocket.

* * * * *